US007138770B2

(12) United States Patent
Uang et al.

(10) Patent No.: US 7,138,770 B2
(45) Date of Patent: Nov. 21, 2006

(54) LED DRIVING CIRCUIT

(75) Inventors: Chii-Maw Uang, Kaohsiung (TW); Wen-Gong Chen, Kaohsiung (TW)

(73) Assignee: Top Union Globaltek Inc., Hsinchu (TW)

( * ) Notice: Subject to any disclaimer, the term of this patent is extended or adjusted under 35 U.S.C. 154(b) by 154 days.

(21) Appl. No.: 11/022,588

(22) Filed: Dec. 27, 2004

(65) Prior Publication Data

US 2006/0138971 A1 Jun. 29, 2006

(51) Int. Cl.
*H05B 37/02* (2006.01)

(52) U.S. Cl. ..... 315/291; 315/193; 315/185 R; 315/192; 315/187

(58) Field of Classification Search ..... 315/291, 315/192, 185 R, 187, 193
See application file for complete search history.

(56) References Cited

U.S. PATENT DOCUMENTS 3,299,341 A * 1/1967 Corey ..... 363/88
5,726,535 A * 3/1998 Yan ..... 315/185 R
5,936,599 A * 8/1999 Reymond ..... 345/82
6,069,452 A * 5/2000 Rossner ..... 315/192
6,641,294 B1 * 11/2003 Lefebvre ..... 362/544
6,830,358 B1 * 12/2004 Allen ..... 362/640
6,972,528 B1 * 12/2005 Shao ..... 315/185 R

* cited by examiner

*Primary Examiner*—Hoang V. Nguyen
*Assistant Examiner*—Chuc Tran
(74) *Attorney, Agent, or Firm*—Alan D. Kamrath; Nikolai & Mersereau, P.A.

(57) ABSTRACT

An LED driving circuit that is directly activated by an AC power supply is disclosed. A driving circuit has a first and second pair of opposite branches. The first pair of opposite branches operates in a positive half cycle of the AC power supply and the second pair of branches operates in a negative half cycle of the AC power supply, so the lighting time for each LED is less than a half cycle time, in other words, the time for heat dissipation is prolonged.

16 Claims, 5 Drawing Sheets

LED DRIVING CIRCUIT

BACKGROUND OF THE INVENTION

1. Field of the Invention

The present invention relates to an LED (light emitting diode) driving circuit, and particularly relates to an LED driving circuit that is capable of activating the LEDs directly by an AC power supply, and the LEDs are arranged in a bridge circuit.

2. Description of Related Art

The LED is developed with advantages of low cost, low power dissipation, and high brightness, which are better than in other illumination devices.

The LED is driven by a DC voltage, so a voltage converter is required to transform an AC voltage to the DC voltage. A common LED driving circuit in prior art has a power supply, a bridge rectifier, a voltage detector and a current direction control circuit, wherein the bridge rectifier is connected to the power supply (AC power supply). The current direction control circuit consists of at least one current control unit, which is further coupled to the LEDs' cathode. The AC voltage is transformed into the DC voltage in the bridge rectifier, and the voltage detector will activate corresponding current direction control circuit based on the detected DC voltage level, to light an appropriate amount of LEDs, meanwhile, a filter capacitor is omitted.

Another example in U.S. Pat. No. 5,457,450 includes two rectifiers and two voltage compensation circuits.

The above examples both have a comparatively complex driving circuit; in addition, the heat dissipation is a problem in the complex circuit, which will further shorten the service life of the LEDs.

Therefore, the invention provides an LED driving circuit to mitigate or obviate the aforementioned problems.

SUMMARY OF THE INVENTION

The main objective of the present invention is to provide an LED driving circuit which can light LEDs and solve the problem of local heat dissipation. Besides, a comparatively simple circuit structure can lower the cost and improve the efficiency of voltage transformation.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
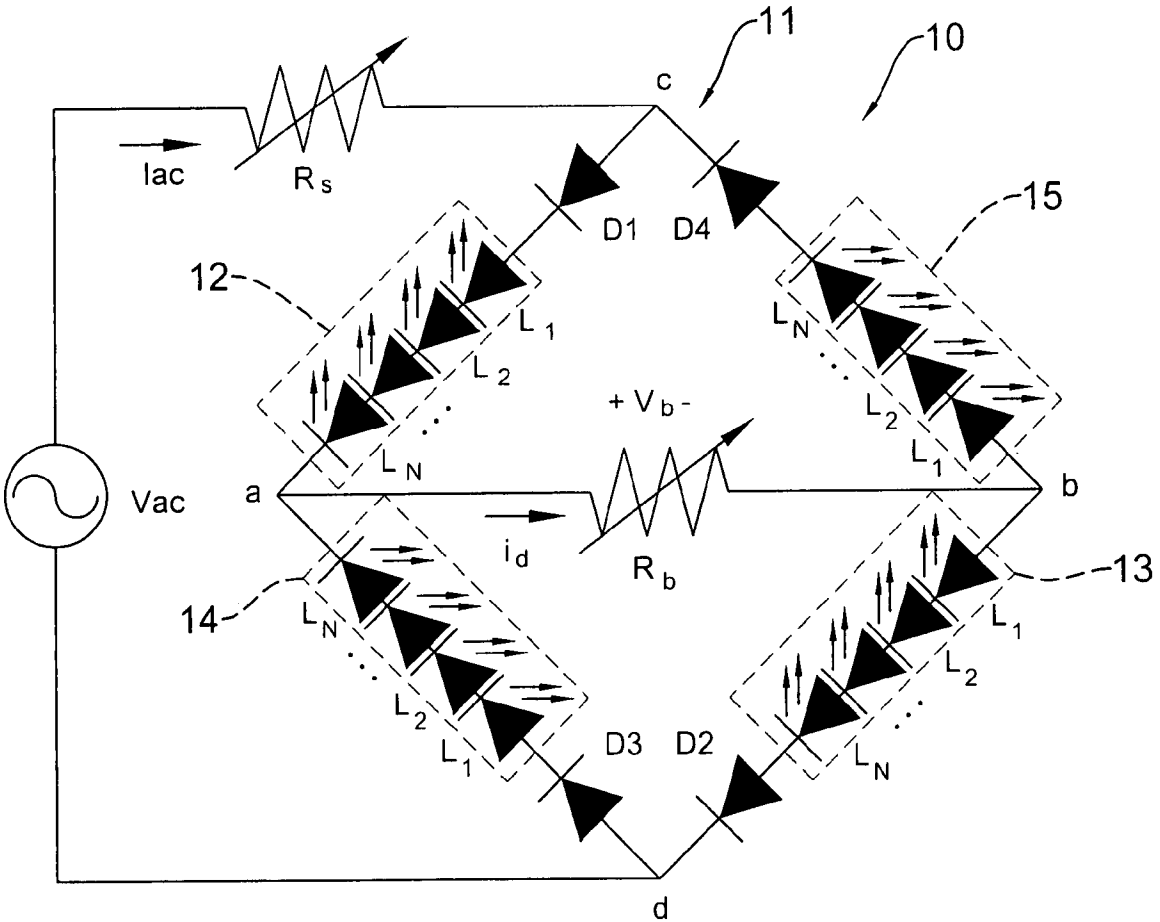
FIG. 1 shows a first embodiment of an LED driving circuit in accordance with this invention.

With reference to FIG. 1, a circuit diagram of a first embodiment of an LED driving circuit is disclosed. An LED driving circuit (10) contains a bridge circuit (11) including a first and second pair of opposite branches arranged in a diamond orientation, and forming four junction points (a), (b), (c), (d). A first pair includes a first branch (a) (c) and a second branch (b) (d); a second pair includes a third branch (a) (d), and a fourth branch (b) (c). Four diodes D1, D2, D3 and D4 are respectively located in four branches. A diagonal branch of the bridge is formed between the junction points (a) and (b), and the junction points (c) and (d) are connected to an AC power supply Vac. That is, the bridge circuit (11) is a two-phase circuit, wherein the two pairs of opposite branches respectively serve as a first current loop and a second current loop.

The current direction in the first current loop is c→a→b→d. The first current loop contains a first and second LED group (12), (13), and each group has multiple LEDs connected in series, wherein the first LED group (12) is connected in the first branch, and the second LED group (13) is connected in the second branch.

The current direction in the second current loop is d→a→b→c. The second current loop has a third and fourth LED group (14), (15), each group has multiple LEDs connected in series, wherein the third LED group (14) is connected in the third branch, and the fourth LED group (15) is connected in the fourth branch.

A current limiting resistor Rs is connected between the AC voltage and the junction point (c) to control a current value, and a power limiting resistor Rb is set at the diagonal branch of the bridge circuit (11) to control an operating power value. The four diodes D1, D2, D3 and D4 are set for preventing the LEDs from reverse breakdown.

Figure 2:
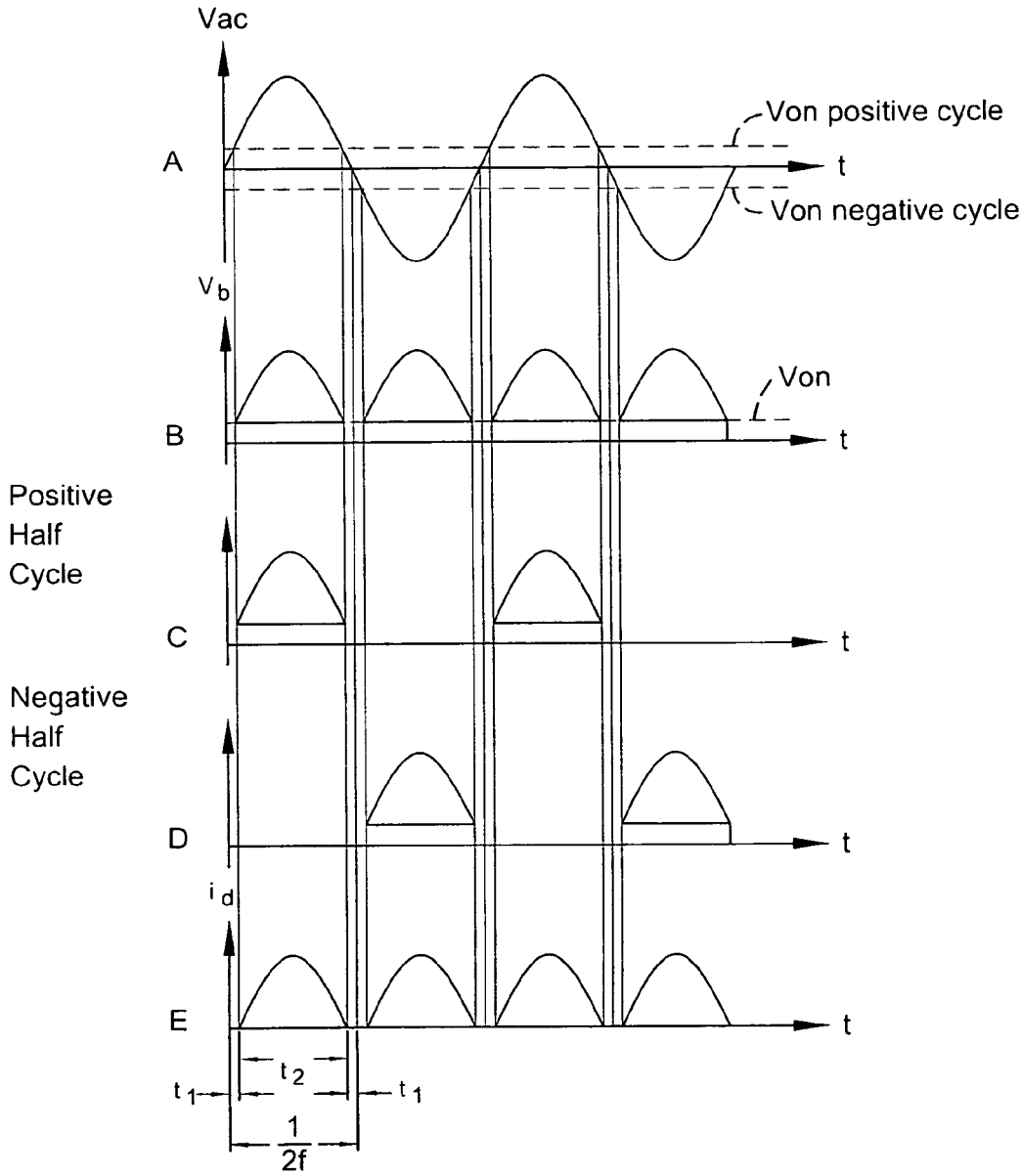
FIG. 2 (A)–(E) shows each related voltage waveshape in the circuit diagram of the first embodiment of the LED driving circuit in accordance with this invention.

With reference to FIG. 2(A), assume that a first threshold voltage of each diodes D1, D2, D3 or D4 is 0.7V, a second threshold voltage of each LED is $V_L$, and the LED number of each LED group is N, thus a third threshold voltage of the bridge circuit (11) is $V_{ON}=(0.7*2)+2NV_L$. When the AC voltage Vac is applied, the first current loop and the second current loop will be alternately activated.

FIG. 2(B) shows a DC voltage obtained from rectifying the AC power supply. The bridge circuit (11) will not be activated until the instantaneous voltage value of the AC voltage reaches $V_{ON}$. As $V_{ON}$ is also presented by $V_{ON}=V_p \sin 2\pi ft$, Thus a non-working time of each LED is $$t_1 = \frac{\sin^{-1}[(2NV_L + 1.4)/V_P]}{2\pi f},$$

and a working time of each LED is $$t_2 = \frac{1}{2f} - 2t_1,$$

as shown in FIG. 2(E), wherein the f here is the voltage frequency. Therefore, duty cycle of each LED is $$DutyCycle = \frac{t_2}{(2t_1 + t_2)} = 2ft_2.$$

When the AC voltage is in a positive half cycle stage as shown in FIG. 2(C), only the first current loop is activated, that is, the current direction is the first branch, the diagonal branch, and the second branch; when the AC voltage supply is in a negative half cycle stage, only the second current loop is activated, that is, the current direction is the third branch, the diagonal branch, and the fourth branch. The instantaneous current of each half cycle stage is:

$$i_d = \begin{cases} \dfrac{V_P \sin(2\pi ft) - 2NV_L - 1.4}{R_S + R_b + R_f}, & t \text{ within } t_2; \\ 0, & t \text{ within } t_1; \end{cases}$$

Wherein the resistor Rf is the total internal resistance of the working LEDs.

Hence the working time of each LED is $t_2$, which is less than the half cycle. Therefore, each LED only heats in $t_2$, while disperses heat in $4t_1+t_2$, in this way, the overheating problem is eliminated.

When the AC voltage is in a negative half cycle stage as shown in FIG. 2(D), the situation is similar to that of the positive half cycle, so the description is omitted.

Figure 3:
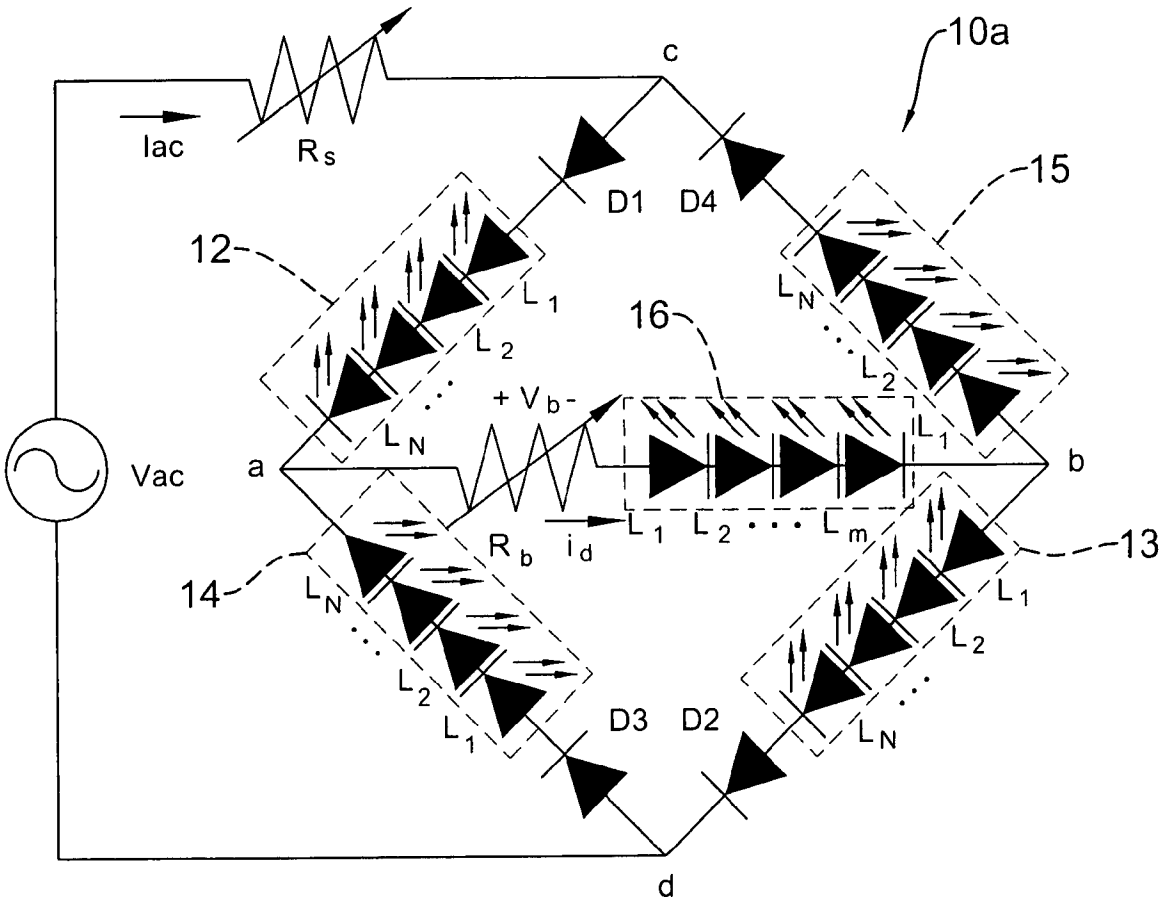
FIG. 3 shows a second embodiment of the LED driving circuit in accordance with this invention.

FIG. 3 shows a second embodiment of a driving circuit (10*a*) in accordance with this invention, which is basically the same as the first embodiment. Only the second resistor Rb in diagonal branch is connected with a fifth LED group (16). In each half cycle, a fourth threshold voltage of the bridge circuit (11) is $$V_{ON}=(0.7\times 2)+2NV_L+mV_l=V_p \sin(2\pi ft_1)$$

wherein m is the LED number of the fifth LED group. The instantaneous current of each half cycle stage is:

$$i_d = \begin{cases} \dfrac{V_P \sin(2\pi ft) - 2NV_L - mV_L - 1.4}{R_S + R_b + R_f}, & t \text{ within } t_2; \\ 0, & t \text{ within } t_1; \end{cases}$$

Figure 4:
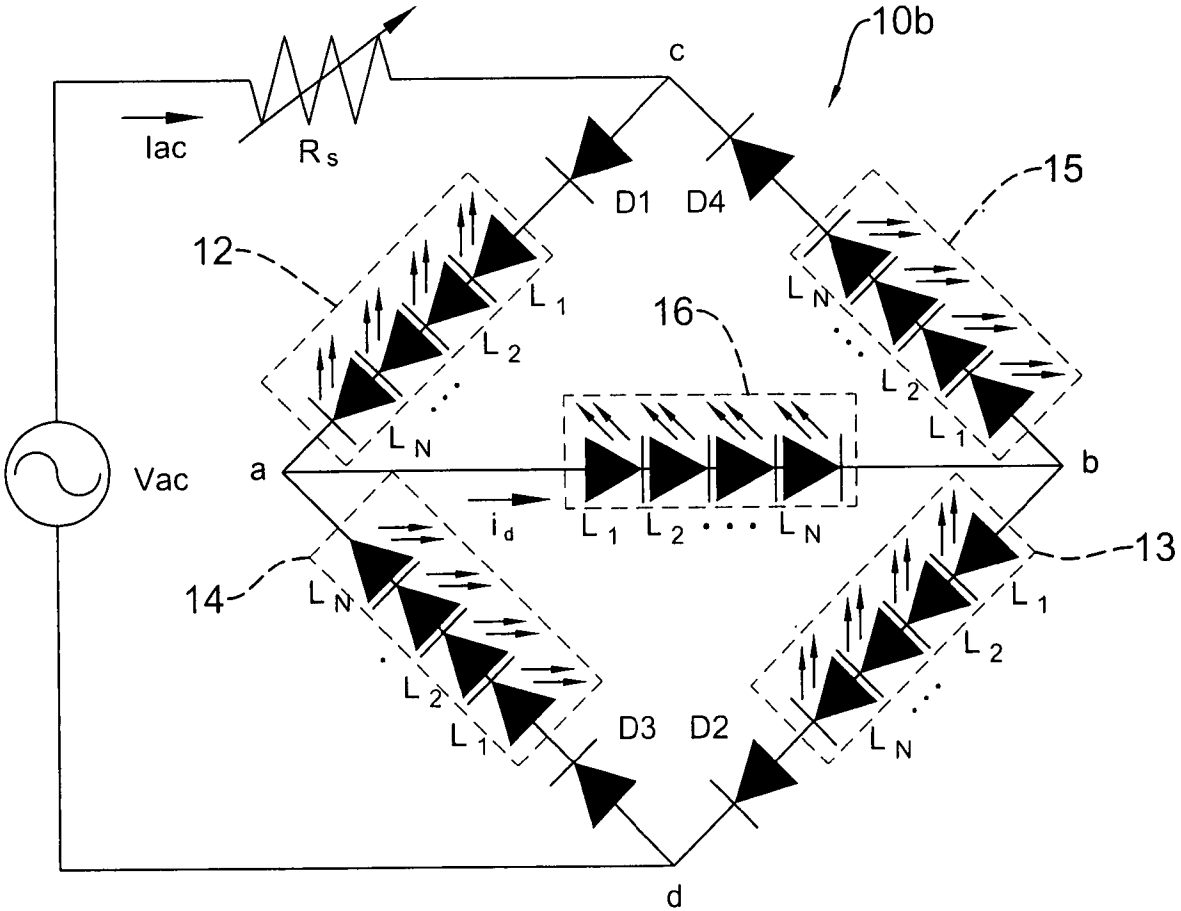
FIG. 4 shows a third embodiment of the LED driving circuit in accordance with this invention.

FIG. 4 shows a third embodiment of a driving circuit (10*b*) in accordance with this invention, wherein the second resistor Rb is removed from the circuit of the second embodiment then a fifth threshold voltage of the bridge circuit (11) is $$V_{ON}=(0.7\times 2)+2NV_L+sV_l=V_p \sin(2\pi ft_1)$$

The instantaneous current of each half cycle stage is:

$$i_d = \begin{cases} \dfrac{V_P \sin(2\pi ft) - 2NV_L - sV_L - 1.4}{R_S + R_f}, & t \text{ within } t_2; \\ 0, & t \text{ within } t_1; \end{cases}$$

Figure 5:
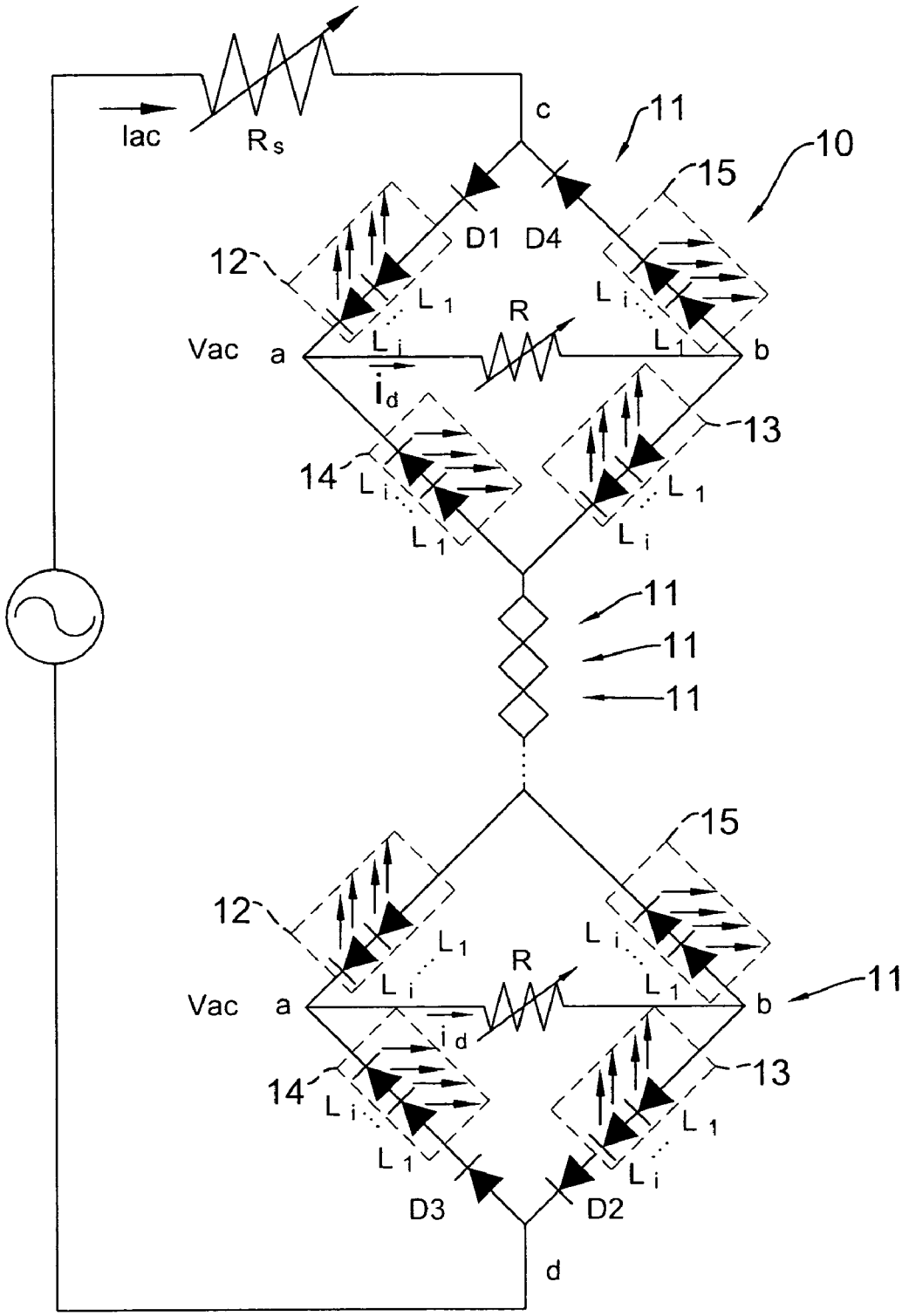
FIG. 5 shows a fourth embodiment of the LED driving circuit in accordance with this invention.

FIG. 5 shows a fourth embodiment of a driving circuit (10*c*) having multiple bridge circuits (11), the junction point (d) of each bridge circuit (11) is attached to the junction point (c) of the next bridge circuit (11), and the junction point (c) of the first bridge circuit (11) and the junction point (d) of the last bridge circuit (11) is connected to the AC voltage. Two diodes D1 and D4 are connected in reverse direction in the first and fourth branches of the first bridge circuit (11) respectively, and two diodes D2 and D3 are connected in reverse direction in the second and third branches of the last bridge circuit (11). Each bridge circuit (11) has a diagonal branch which has a resistor R connected therein.

The first branches, the diagonal branch, and the second branches of all bridge circuits (11) form a first current loop, wherein each first branch has a first LED group (12), and each second branch has a second LED group (13).

The third branches, the diagonal branches, and the fourth branches of all bridge circuits (11) form a second current loop, wherein each third branch has a third LED group (14), and each fourth branch has a fourth LED group (15).

In a situation that the total resistance of all LED groups is equal to that of all LED groups in the first embodiment and the third resistor R is equal to the second resistor Rb, then the $V_{on}$ and the $i_d$, will be the same as that of the first embodiment. In addition, the current limiting resistor Rs can be connected between the AC voltage and the junction point (c) of the first bridge circuit (11), and the fifth LED group can be connected in each diagonal branch of all the bridge circuits (11).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An LED driving circuit comprising:

a bridge circuit (11) having a first and second pair of opposite branches, a diagonal branch connected between two opposite junction points of the bridge circuit (11), and another two junction points attached to an AC power supply, wherein each branch has a diode;

a first current loop having LED groups and coupled to the diagonal branch and the first pair of branches, where each branch is connected to an LED group in series, wherein the first current loop is activated in a positive half cycle of the AC power supply; and a second current loop having LED groups and coupled to the diagonal branches and the second pair of branches, where each branch is connected to an LED group in series, wherein the second current loop is activated in a negative half cycle of the AC power supply.

2. The LED driving circuit as in claim 1 wherein a current limiting resistor is connected between the AC power supply and one of the junction points.

3. The LED driving circuit as in claim 2 wherein a power limiting resistor is connected to the diagonal branch.

4. The LED driving circuit as in claim 3 wherein an LED group is connected to the diagonal branch.

5. The LED driving circuit as in claim 2 wherein an LED group is further connected to the diagonal branch.

6. The LED driving circuit as in claim 1 wherein a power limiting resistor is connected to the diagonal branch.

7. The LED driving circuit as in claim 6 wherein an LED group is connected to the diagonal branch.

8. The LED driving circuit as in claim 1 wherein an LED group is further connected to the diagonal branch.

9. An LED driving circuit comprising:

multiple bridge circuits (11) each having a first and second pair of opposite branches, and a diagonal branch connected between a pair of two opposite junction points (a and b) of each bridge circuit, which are connected one to another in series in another pair of opposite junction points (c and d), wherein one junction point (c) of a first bridge circuit and one junction point (d) of a last bridge circuit are attached to an AC power supply, and two branches joined by junction point (c) of the first bridge circuit respectively have a diode connected in reverse direction, while two branches joined by junction point (d) of the last bridge circuit respectively have a diode connected in reverse direction;

a first current loop having LED groups coupled to the diagonal branches and the first pairs of branches of all bridge circuits, where each branch of the first pairs is connected to an LED group, wherein the first current loop is activated in a positive half cycle of the AC power supply;

a second current loop having LED groups coupled to the diagonal branches and the second pairs of branches of all bridge circuit, each branch of the second pairs connected to an LED group, wherein the second current group is activated in a negative half cycle of the AC power supply.

10. The LED driving circuit as in claim 9 wherein a current limiting resistor is connected between the AC power supply and the junction point (c) of the first bridge circuit.

11. The LED driving circuit as in claim 10 wherein a power limiting resistor is connected to the diagonal branch of each bridge circuit.

12. The LED driving circuit as in claim 11 wherein an LED group is connected to the diagonal branch of each bridge circuit.

13. The LED driving circuit as in claim 10 wherein an LED group is connected to the diagonal branch of each bridge circuit.

14. The LED driving circuit as in claim 9 wherein a power limiting resistor is connected to the diagonal branch of each bridge circuit.

15. The LED driving circuit as in claim 14 wherein an LED group is connected to the diagonal branch of each bridge circuit.

16. The LED driving circuit as in claim 9 wherein an LED group is connected to the diagonal branch of each bridge circuit.

* * * * *